US010986921B2

(12) United States Patent
Held

(10) Patent No.: US 10,986,921 B2
(45) Date of Patent: Apr. 27, 2021

(54) CABINET

(71) Applicant: FORM ORANGE PRODUKTENTWICKLUNG, Hard (AT)

(72) Inventor: Wolfgang Held, Hard (AT)

(73) Assignee: FORM ORANGE PRODUKTENTWICKLUNG, Hard (AT)

( * ) Notice: Subject to any disclaimer, the term of this patent is extended or adjusted under 35 U.S.C. 154(b) by 0 days.

(21) Appl. No.: 16/471,390

(22) PCT Filed: Dec. 19, 2017

(86) PCT No.: PCT/EP2017/083537
§ 371 (c)(1),
(2) Date: Jun. 19, 2019

(87) PCT Pub. No.: WO2018/114947
PCT Pub. Date: Jun. 28, 2018

(65) Prior Publication Data

US 2019/0387874 A1 Dec. 26, 2019

(30) Foreign Application Priority Data

Dec. 22, 2016 (DE) ..... 10 2016 125 436.3

(51) Int. Cl.
*E05F 1/10* (2006.01)
*A47B 96/00* (2006.01)
(Continued)

(52) U.S. Cl.
CPC ..... *A47B 57/06* (2013.01); *A47B 46/005* (2013.01); *A47B 49/004* (2013.01); *E05D 15/40* (2013.01); *E05F 1/1041* (2013.01)

(58) Field of Classification Search
CPC ..... A47B 57/06; A47B 46/005; A47B 49/004
See application file for complete search history.

(56) References Cited

U.S. PATENT DOCUMENTS 2,488,431 A * 11/1949 Parnell ..... A47B 67/02 312/305
2,692,813 A * 10/1954 Toronto ..... F25D 25/027 312/408

(Continued)

FOREIGN PATENT DOCUMENTS

AT 14 963 U1 9/2016
AT 14963 U1 * 9/2016

(Continued)

*Primary Examiner* — Kimberley S Wright
(74) *Attorney, Agent, or Firm* — John Alumit

(57) ABSTRACT

The application includes a cabinet, having a cabinet body that has a back wall, a top wall and at least one shelf, the open side of which cabinet is closable by at least one covering swivelably connected to the cabinet body; having tilt fittings for the covering that are attached in the upper vicinity of the cabinet body and are covered by inner walls; and having front facings, located between the side walls and the inner walls of the cabinet body and lowerable in the closing position of the covering toward the back side of the cabinet body. In the open position of the covering, the front facings entirely cover the space between the side walls, the inner walls, the tilt fittings, and the shelf, and are flush with the face end of the cabinet body, and the inner walls entirely cover the tilt fittings and front facings. The front facings are each connected to a travel-limiting, adjustable guide device.

3 Claims, 12 Drawing Sheets

(51) Int. Cl.

| | |
|---|---|
| ***A47B 57/06*** | (2006.01) |
| ***A47B 46/00*** | (2006.01) |
| ***A47B 49/00*** | (2006.01) |
| *E05D 15/40* | (2006.01) |

(56) References Cited

U.S. PATENT DOCUMENTS 2,955,892 A * 10/1960 Pulaski ..... A47B 49/004 312/310
2,963,171 A * 12/1960 Johnson ..... F25D 25/027 108/139
3,167,186 A * 1/1965 Squire ..... F25D 25/027 211/150
3,172,715 A * 3/1965 Powder ..... F25D 25/027 312/298
3,264,049 A * 8/1966 Peterson ..... F25D 25/02 312/304
4,738,495 A * 4/1988 Mitts ..... A47B 49/006 108/140
8,636,327 B2 * 1/2014 Penner ..... B25H 3/025 280/43.17
10,111,521 B2 * 10/2018 Chen ..... A47B 49/006
10,151,526 B1 * 12/2018 Pathapati ..... F25D 23/04
2006/0163984 A1 * 7/2006 Andersen ..... A47F 3/0486 312/401
2010/0270438 A1 * 10/2010 Pandorf ..... A47B 67/02 248/65

FOREIGN PATENT DOCUMENTS

DE 1813282 U 6/1960
DE 10 2015 005484 A1 11/2016
DE 102015005484 * 11/2016
WO WO 2009/026950 A1 3/2009
WO WO-2009026950 A1 * 3/2009 ..... A47F 3/0486

* cited by examiner

CABINET

The present invention relates to a cabinet as generically defined by the preamble to claim 1, and to front coverings as defined by the preamble to claim 15.

Cabinets of the type referred above are known for instance from published patent document AT 14 963 U1. The tilt fittings secured to the side walls of the cabinet body are each covered by a respective inner wall. The resultant gap between the side wall and inner wall is covered in the closed position of the flap door by the door itself and in the open position of the flap door by front facings. This prevents foreign bodies from being able to get into the gap. The front facings are embodied as vertical strips, which have a joint on the lower end so that the strips can be hinged inward in the gaps by the tilt fittings. A disadvantage is that in the open state of the flap door, the front coverings are not flush with the face end of the cabinet body and make the cabinet harder for the user to use. In terms of appearance as well, the effect is bothersome for the viewer, since every piece of furniture is not merely a useful object but also has an aesthetic aspect.

In addition, on the one hand, cabinets in general are known that have one or more compartments, which are located at adjustable heights in the cabinet body.

On the other hand, from published patent document DE 1 813 282 U, a cabinet with four doors is known in which a compartment is secured to the lower inner edge of the door. Thus when the door is opened, the compartment can be swiveled outward. It is disadvantageous that the compartment is moved outward every time the door is opened, even if there is no need for that at all.

It is the object of the invention to improve the existing front facings, to utilize inner walls employed for that purpose for securing secure movable shelves, and thereby to achieve optimal functionality, optimal use of space, and an optimal visual appearance.

This object is attained in each case by the features of claim 1 and claim 15.

It is apparent that in any case, the invention is realized whenever a cabinet with a cabinet body has a back wall, a top wall, and at least one shelf, the open cabinet side of which is closable by at least one covering hinged to the cabinet body, having tilt fittings for the covering that are attached to the inner sides of the side walls in the upper region of the cabinet body and are covered by inner walls, as well as having front facings located between the side walls and the inner walls of the cabinet body that can be lowered in the closing position of the covering toward the back side of the cabinet body. In the open position of the covering, the front facings completely cover the space between the side walls, the inner walls, the tilt fittings, and the shelf and close flush with the face end of the cabinet body. The inner walls cover the tilt fittings and front facings completely. The front facings are each connected to a respective travel-limiting and adjustable guide device.

Very generally, the invention is also realized whenever it involves a cabinet having a cabinet body that has walls, and the open cabinet side of which can be covered by at least one covering hinged to the cabinet body, and having inner walls each of which, with associated side walls, forms a vertically extending gap, which receives a fitting for the covering and which can be covered by a front facing. The front facing covers the gap in the open position of the covering and cooperates with an actuation device, by which the positions of the front facing can be adjusted.

This cabinet has a cabinet body with a back wall, a top wall, and at least one shelf; the open side of the cabinet can be closed with at least one covering that is hinged to the cabinet body. Furthermore, the cabinet has not only tilt fittings for the covering, which are mounted on the inner sides of the side walls in the upper region of the cabinet body and are covered by inner walls, but also front facings, which are located between the side walls and the inner walls of the cabinet body and which can be lowered toward the cabinet body back side in the closing position of the covering. The front facings, in the open position of the covering, cover the space between the side walls, inner walls, tilt fittings and shelf completely and close flush with the face end of the cabinet body; the inner walls completely cover the tilt fittings and front facings, and the front facings are each connected to a travel-limiting and adjustable guide device. Furthermore, front facings for a cabinet having at least one covering hinged to the cabinet body are provided, and the covering is movable between a closed and an open position.

Further improvements are attached as a result of the features of the dependent claims. In a first functionally advantageous embodiment, the front facings are guided movably by the tilt fittings counter to a spring force upon closure of the covering, and as a result an automatic restoration of position occurs when the covering is opened.

In a second functionally advantageous embodiment, the front facings, in their entire length, can be lowered horizontally parallel to the face end of the cabinet body counter to a spring force, and as a result, the adjustability of the front covering is improved with respect to a flush adjustment relative to the face end of the cabinet body.

In a third functionally advantageous embodiment, the front facings are supported in such a way that by swiveling 90°, they can be lowered counter to a spring force in the front region of a side or inner wall; as a result, the adjustability of the front covering is improved with respect to a flush setting relative to the face end of the cabinet body.

In a fourth embodiment, the front facings are supported in such a way that they can be swiveled about a pivot point in the front region of the shelf, so that they can be lowered counter to a spring force.

In a fifth functionally advantageous embodiment, the guide device can be guided movably along a housing that is located between the side wall and the associated inner wall.

In a sixth functionally advantageous embodiment, the guide device has at least two hinges, which can be secured to the side wall or the inner wall.

In a seventh embodiment, the guide device has at least one hinge, which can be secured to the shelf or to a housing, located between the side wall and the associated inner wall, of the guide device.

In an eighth functionally advantageous embodiment, at least one shelf, which can be secured to the inner walls or to the back wall, can be located movably in the cabinet body.

In a ninth functionally advantageous embodiment, at least one shelf is provided that is smaller than half the width of the cabinet body and that can be moved rotatably out of the cabinet body at a fitting which can be secured to one of the inner walls in the vicinity of the front side of the cabinet body.

In a tenth functionally advantageous embodiment, the shelf is adjustable in height in the fitting, and the shelf has an outline similar to a quarter circle, with a flattened shelf corner that is adapted to the back wall of the cabinet body.

In an eleventh functionally advantageous embodiment, at least one triangular shelf is provided in the middle of the cabinet body; this shelf can be secured adjustably in height at a fitting that is secured to the back wall of the cabinet body, and its triangular side opposite the shelf is adapted to the circular shape of the shelf.

In a twelfth functionally advantageous embodiment, the shelf is secured rotatably at a multi-way rotary fitting that in turn is essentially secured to the back wall of the cabinet body and is intended for a circular shelf located in the middle of the cabinet body; the shelf is adapted on one of its sides to the circular shape of the circular shelf, and on the opposite side that shelf is adapted to swivel outward from the cabinet body.

In a thirteenth functionally advantageous embodiment, the shelf has a fitting with which it can be connected to at least one further shelf and/or at least one inner wall, and by way of the fitting, the shelf can either be adjustable in height and/or can be pushed outward.

In a fourteenth embodiment that is advantageous for the production and function, the guide device is operatively connected to a helical spring located in the housing, and the helical spring can be loaded for either compression or tension.

In a fifteenth embodiment that is advantageous both functionally and in terms of production, the guide device or the front facing is operatively connected either to a spiral spring or to a spring that can be loaded for compression.

In a sixteenth embodiment that is advantageous for the production and function, the guide device or the front facing is operatively connected either to a spiral spring or a helical spring located in the interior of the housing; the helical spring can be loaded for compression or torsion.

In a seventeenth embodiment that is advantageous for the production and function, the guide device has a vertical panel that is plane-parallel and connected to the front facing, and a guide panel, located perpendicular to this vertical panel; the guide panel has a strut that is operatively connected to the helical spring.

In an eighteenth embodiment that is advantageous for the production and function, the guide panel is provided, on its end facing away from the front facing, with an adjustable stop, which cooperates with at least one counterpart stop located on the side wall or inner wall or housing; the guide panel is supported by a ball bearing and is operatively connected to a ball bearing guide, which is connected to the side wall or inner wall or to the housing.

In a nineteenth embodiment that is advantageous for the production and function, the housing can take the form of an open or closed body, such as a U-profile or a square tube and can have holes and/or oblong slots for securing it to the shelf and/or to the side wall and/or to the associated inner wall, as well as a receptacle for a helical spring; the receptacle is connected to the interior of the housing and can have slits along its longitudinal axis on two opposite sides.

The invention will now be described in further detail in conjunction with the drawings. In the drawings.

Figure 1:
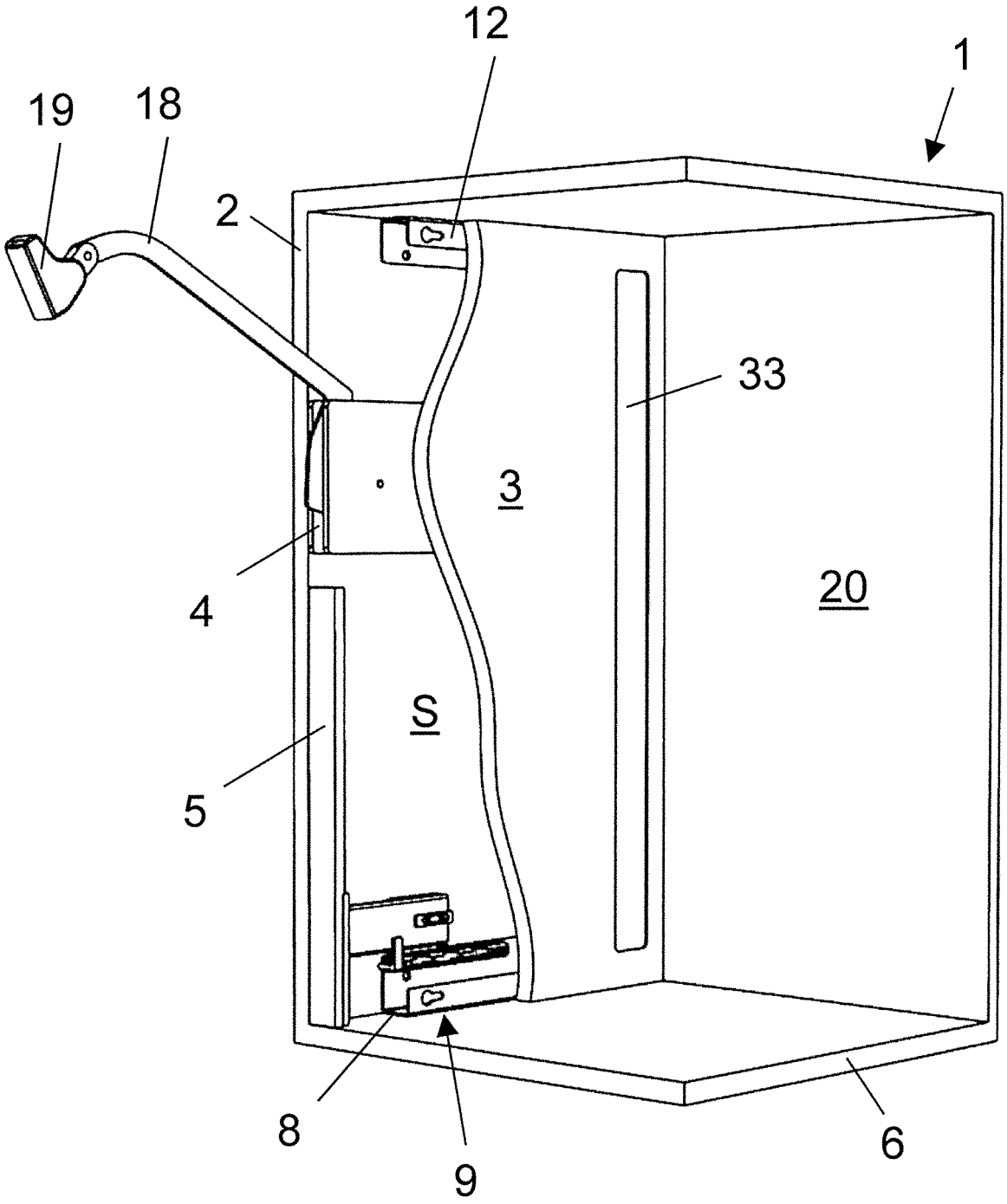
FIG. 1 is a perspective view of one embodiment of a left-hand part of a cabinet body, having a tilt fitting arm, hinged to move upward, for a covering, not shown, and having a first guide device for a front facing.
Figure 2:
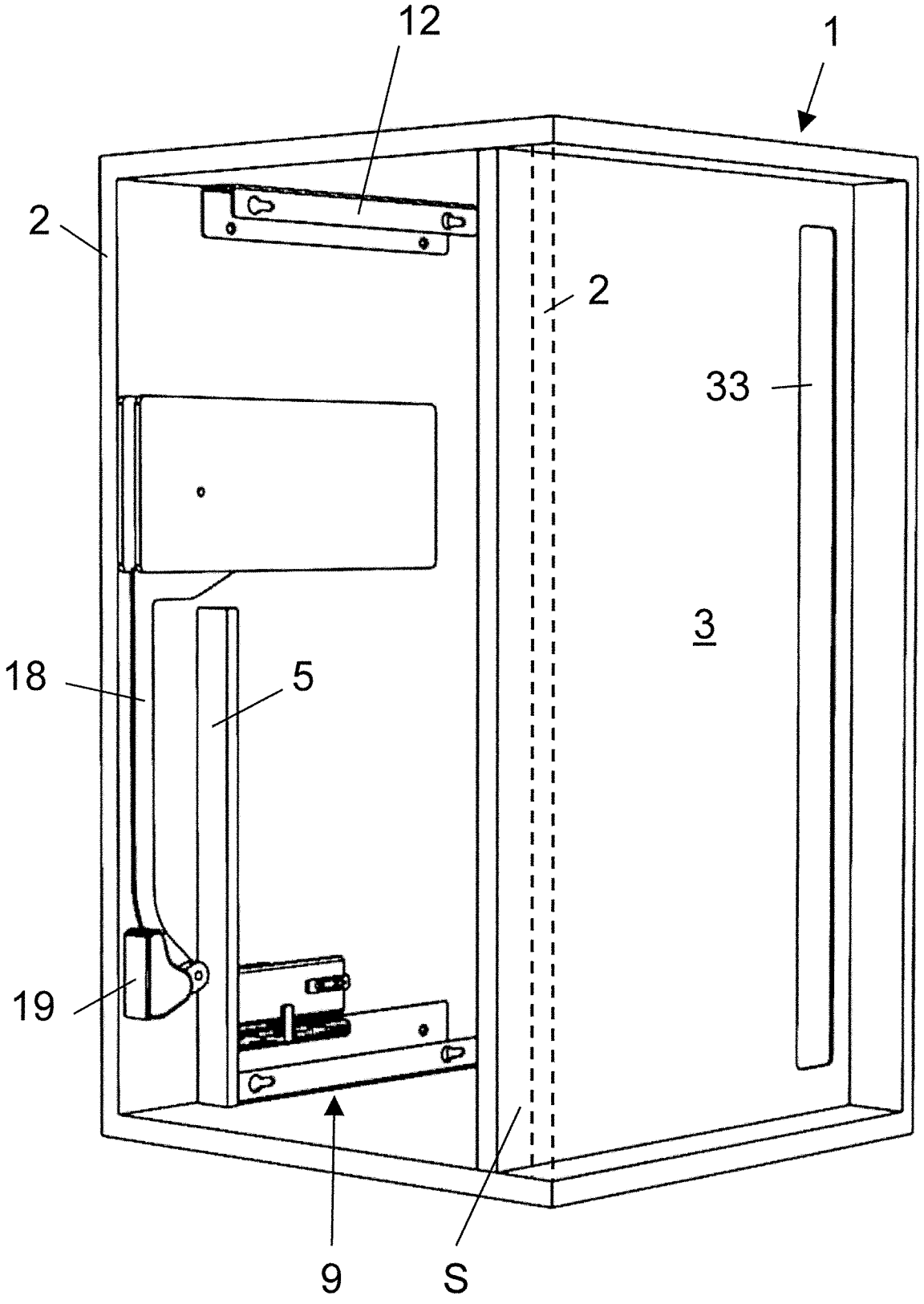
FIG. 2 is a perspective view as in FIG. 1 with the partly opened front facing, in which the front facing is guided horizontally inward into the cabinet body.

FIGS. 1 and 2 show a cabinet, in particular a wall cabinet, with a cabinet body 1 which has walls 2, 20 and the open cabinet side of which can be covered by at least one covering hinged to the cabinet body 1, and which has inner walls 3 that which together with associated side walls 2 each form a vertically extending gap S, which receives a fitting 4 for the covering and which can be covered by a front facing 5, 5', 5". The front facing 5, 5', 5" covers the gap S in the open position of the covering and cooperates with an actuating device 7, 7', 7" by which the positions of the front facing 5, 5', 5" can be adjusted.

Figure 11:
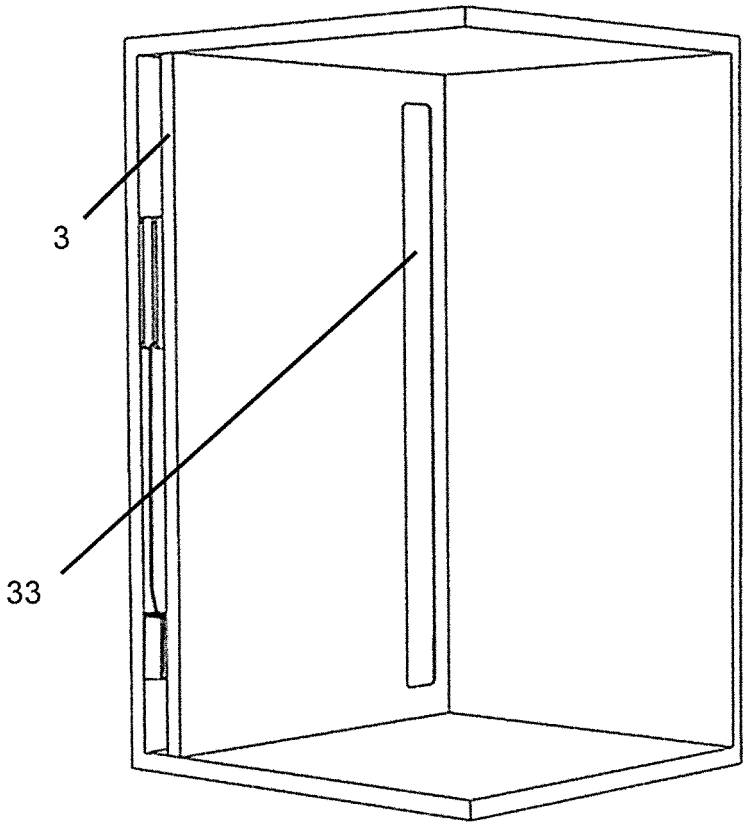
FIG. 11 is a perspective view as in FIGS. 1 through 10 with an inner wall.

FIG. 1, in one embodiment of the invention, shows the left-hand part of a rectangular cabinet body 1, consisting of a shelf 6, a top wall, a back wall 20, and a side wall 2. A tilt fitting 4 with a housing that has a spring-loaded, vertically rotatable tilt fitting arm 18 is secured to the side wall 2. A covering holder 19, on which a covering, not shown, can be secured, is hinged to the outer end of the tilt fitting arm 18. The tilt fitting 4 is covered by an inner wall 3 shown in FIG. 11; the inner wall 3 can have at least one opening 33 through which the interior of the cabinet body 1 can be illuminated. The inner wall 3 is fixed on a U-shaped upper profile 12, secured to the side wall 2, and on a U-shaped lower profile 8 secured to the side wall 2. Further shelves 21, 21', 21", 21''', 21'''', 24, not shown in FIG. 1, can be secured to the inner walls 3. The gap between the side wall 2 and the inner wall 3 created when the tilt fitting arm 18 is hinged upward could allow foreign bodies to enter and should be covered after the tilt fitting arm 18 has been hinged upward.

Figure 3:
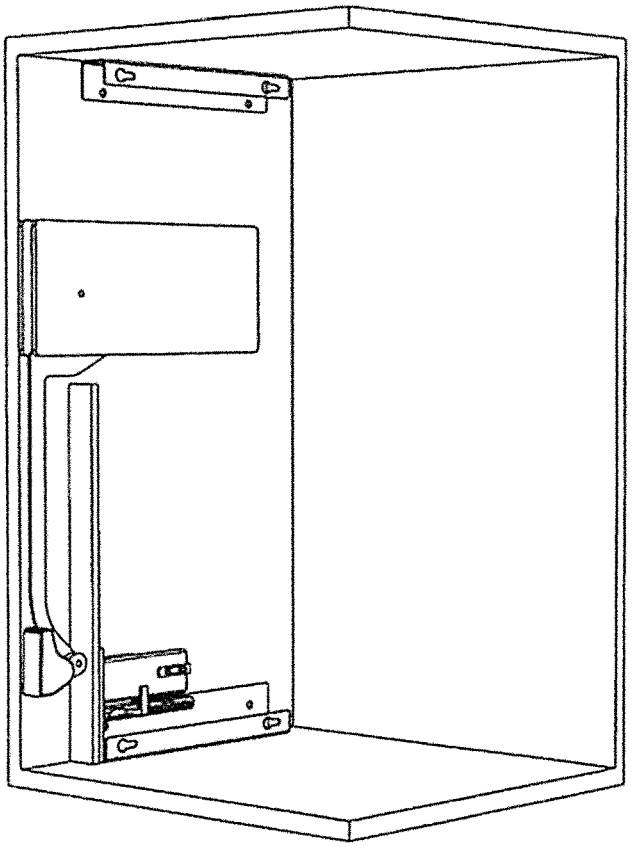
FIG. 3 is a perspective view as in FIG. 1 with the front facing completely opened.
Figure 4:
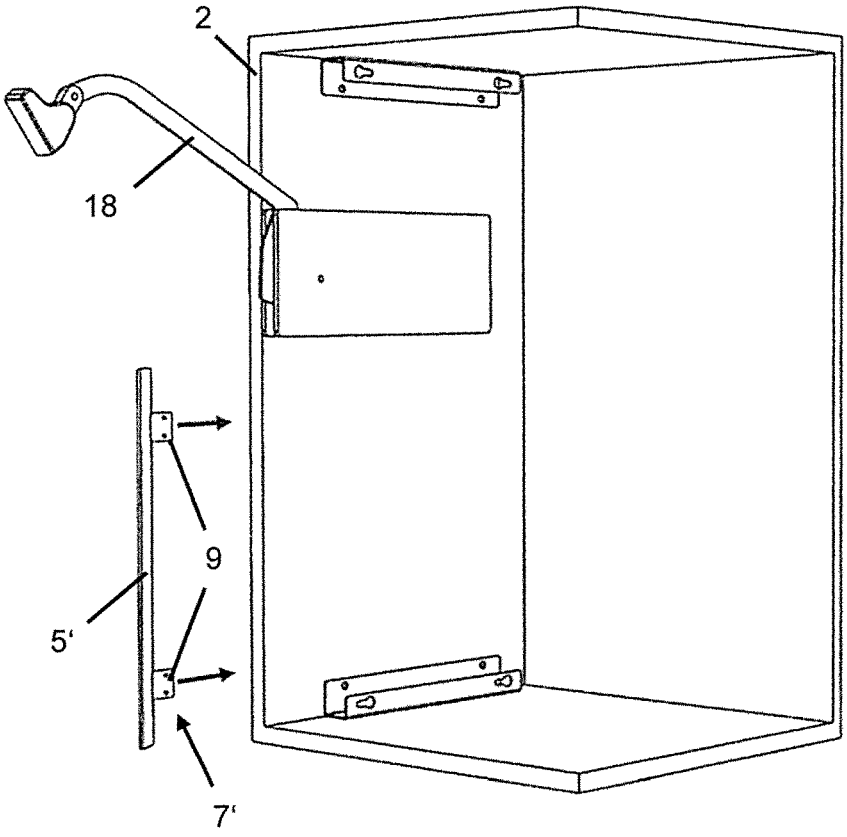
FIG. 4 is a perspective view of a further embodiment that has a second guide device for the front facing.

The facing is accomplished using a vertical, striplike front facing 5, which is guided horizontally by a guide device 7, as can be seen from FIGS. 1-3.

Figure 12:
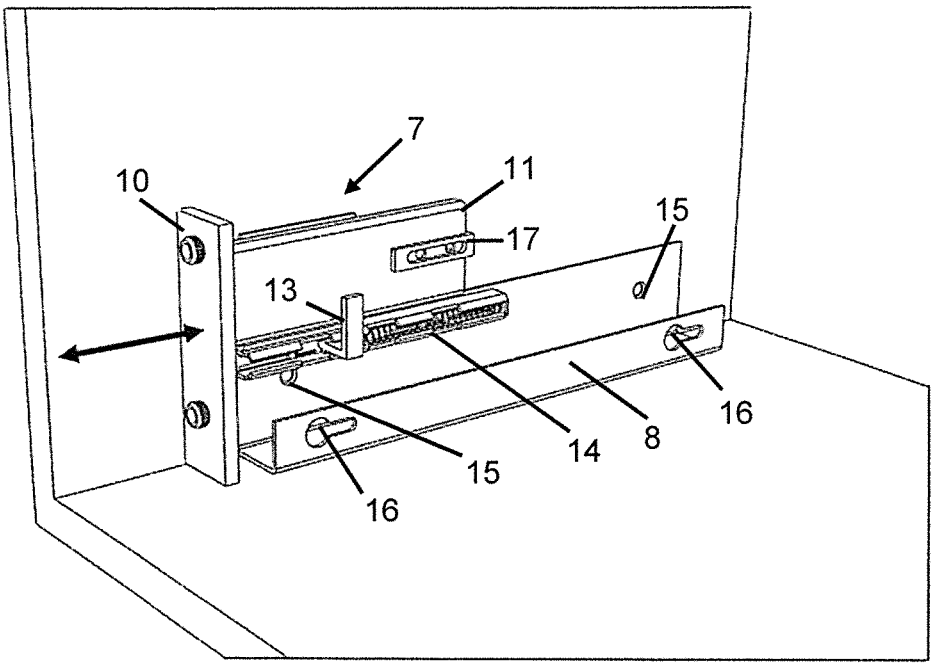
FIG. 12 is a more-detailed perspective view of the lower region of FIG. 1 that has the first guide device for the front facing.

Folding the covering, not shown, downward causes the tilt fittings 4, in particular the tilt fitting arm 18 and/or the covering holder 19, to be pressed against the front facings 5, and as a result they are guided horizontally into the interior of the space toward the back side of the cabinet body, between the side wall 2, the inner wall 3, the tilt fittings 4, and the shelf 6. FIGS. 2 and 3 show the situations with the covering partly closed and completely closed. In FIG. 2, the horizontal motion of a guide device 7, connected to the front facing 5, is indicated by an arrow. In FIG. 12, the guide device 7 is shown in more detail. It consists of a plane-parallel vertical panel 10, connected to the front facing 5, and a guide panel 11, positioned vertically to that vertical panel; the guide panel is guided along a U-profile 8, located between the side wall 2 and the associated inner wall 3 not shown in FIG. 12, and is thus guided horizontally counter to a spring force upon closure of the covering. The guide panel 11 has a strut 13, which is operatively connected to a helical spring 14 located in the profile 8. The profile 8, in its interior, can have a receptacle, connected to the profile 8, for the helical spring 14; this receptacle can have slots along its longitudinal axis on two opposite sides. Depending on the location of the strut 13 on the guide panel 11, the helical spring 14 can be either compressed or stretched. The profile 8 has mounting holes 15 for securing it to the side wall 2 and mounting holes 16 which can each also be embodied as an oblong slot, for securing to the inner wall 3. The guide panel 11 can have a ball bearing that cooperates with a ball bearing guide located on the side wall 2, the inner wall 3, or the housing 8 and that is provided, on its end facing away from the front facing 5, with an adjustable stop 17 as well as with at least one counterpart stop, not shown, that is located on the side wall 2, the inner wall 3, or the housing 8. The stop 17 can take various embodiments of the tilt fitting arm 18 into account and can adjustably limit the travel in both horizontal directions and thus prevent the front facing 5, in the open state of the covering, from being moved too far outward and thus outward past the face end of the cabinet body 1.

Figure 5:
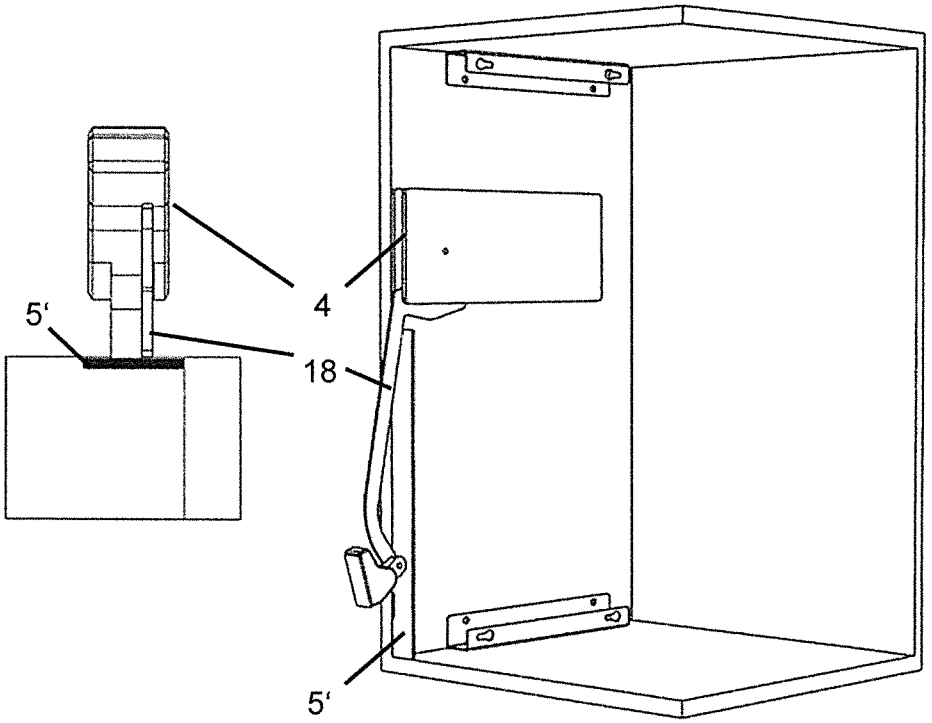
FIG. 5 is a perspective view as in FIG. 4, with a front that is not yet opened.
Figure 6:
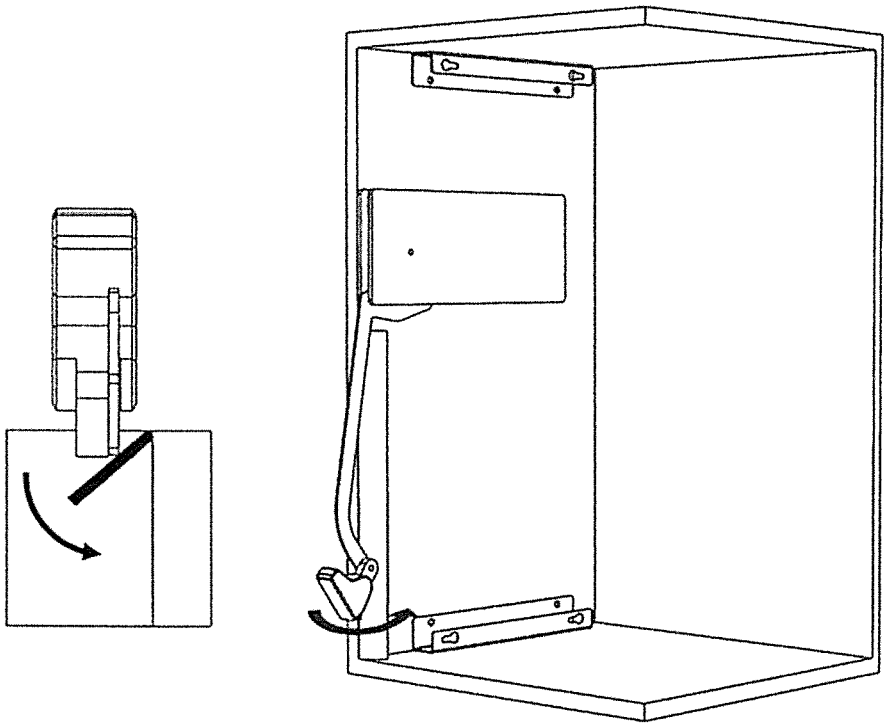
FIG. 6 is a perspective view as in FIG. 4, with the front facing partly opened.
Figure 7:
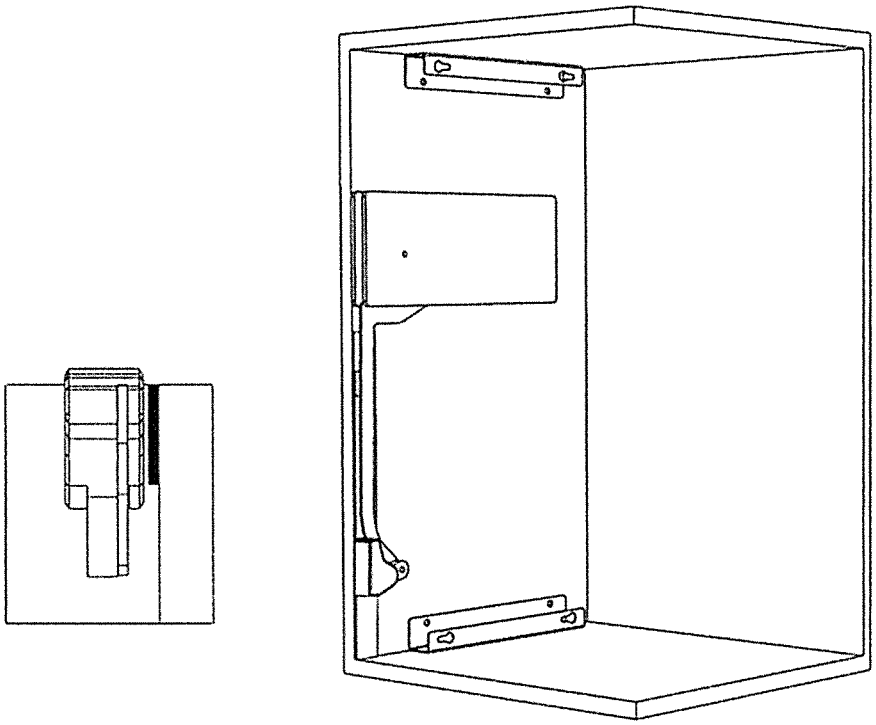
FIG. 7 is a perspective view as in FIG. 1, with the front facing completely opened.

In the embodiment of the invention shown in FIGS. 4-7, the actuation of a front facing 5' is done with the aid of a guide device 7' in the form of two spring-loaded hinges 9 secured to the front facing 5' and to the side wall 2. The embodiment of the spring can involve a spiral spring, for instance. As the tilt fitting arm 18 is lowered, the front facing 5' is hinged toward the back side of the cabinet body, inward to the side wall 2. FIGS. 5-7 make this process clear. However, when suitably mounted on the inner wall 3, not shown in FIGS. 4-7, the front facing 5' can also be hinged toward the inner wall 3. Instead of the spiral spring, some other kind of spring is also conceivable, for instance one which can be secured to the side wall 2 or inner wall 3 and cooperates with the front facing 5'. In addition, adjustable travel limiters can also be integrated with the hinges, and these limiters prevent the front facing 5' in the open state of the covering from being moved too far outward and thus past the face end of the cabinet body 1.

Figure 8:
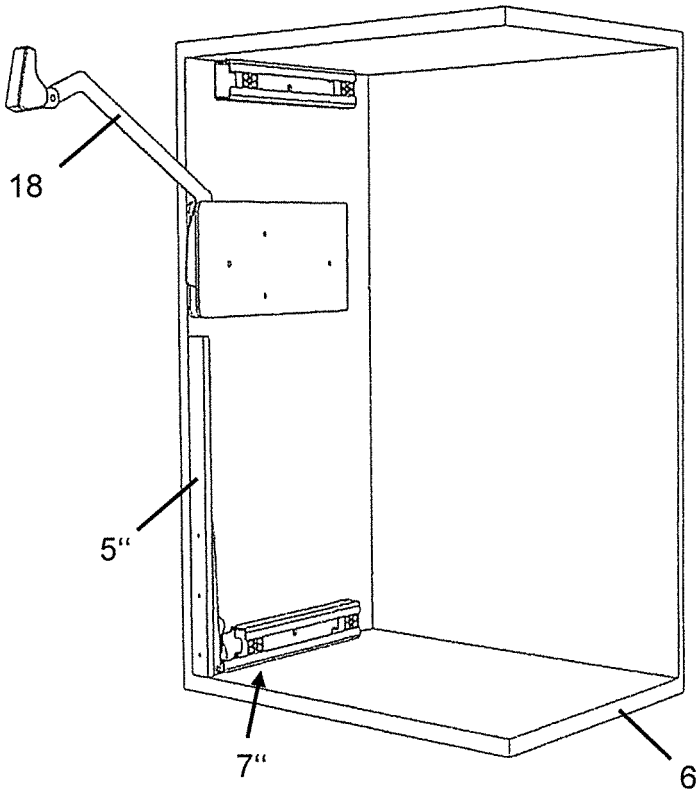
FIG. 8 is a perspective view of a further embodiment that has a third guide device for the front facing.
Figure 9:
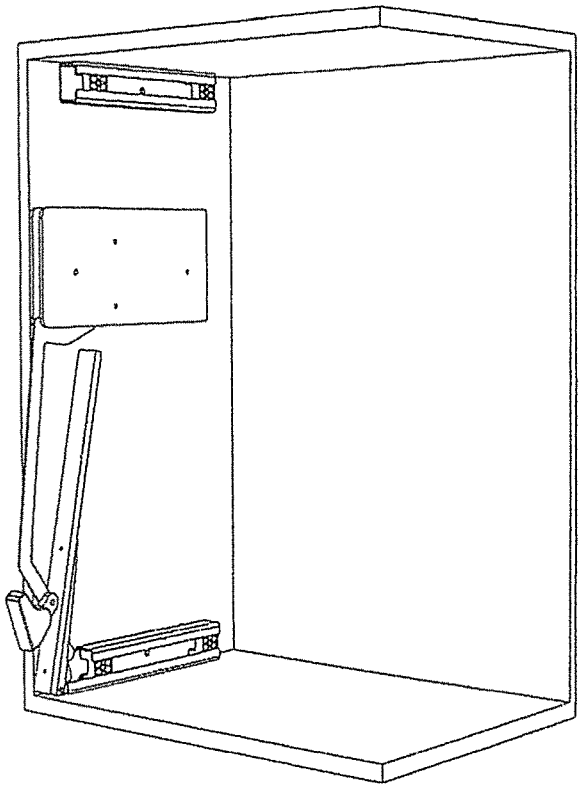
FIG. 9 is a perspective view as in FIG. 8, with the front facing partly opened.
Figure 10:
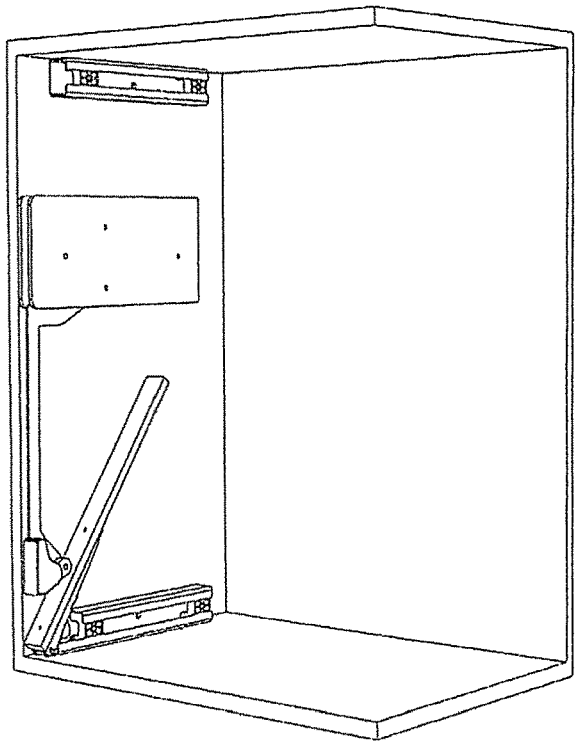
FIG. 10 is a perspective view as in FIG. 8, with the front facing completely opened.

In the embodiment of the invention shown in FIGS. 8-10, the actuation of a front facing 5" is performed with the aid of a guide device 7" in the form of a spring-loaded hinge that is secured to the front facing 5" and the shelf 6, or to a housing of the guide device 7". The embodiment of the spring can for instance involve a spiral spring. When the tilt fitting arm 18 is lowered, the front facing 5" is hinged inward, toward the shelf 6, on the back side of the cabinet body. Instead of the spiral spring, however, a helical spring is also conceivable, which is received and supported in the interior of the housing of the guide device 7". It can both be loaded for compression and can cooperate directly with the front facing 5" or the hinge, or it can be loadable for tension and can cooperate with a rod, which is connected to the front facing 5" or the hinge and which is connected to the end of the helical spring oriented toward the back side of the cabinet body. Furthermore, an adjustable travel limiter can be integrated with the hinge and prevents the front facing 5", in the open state of the covering, from being moved too far outward and thus past the face end of the cabinet body 1.

Figure 13:
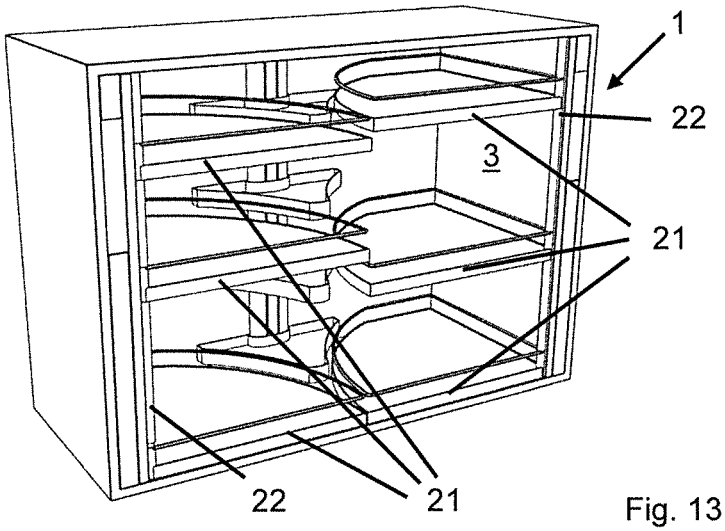
FIG. 13 is a perspective view of a cabinet body with six shelves and two fittings located on the front side of the cabinet body.
Figure 14:
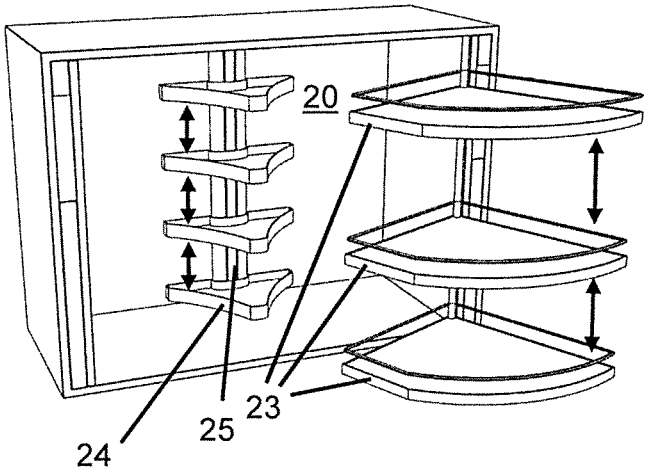
FIG. 14 is a perspective view as in FIG. 13.
Figure 15:
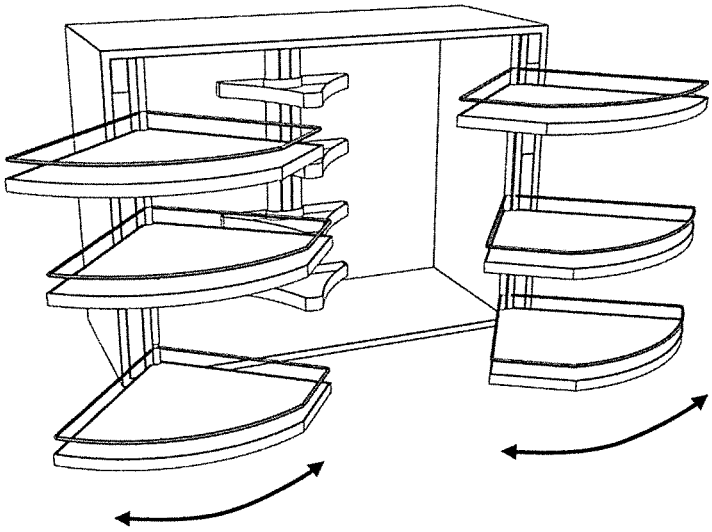
FIG. 15 is a perspective view as in FIGS. 13 and 14.

FIG. 13 shows the rectangular cabinet body 1, in which six shelves 21 are accommodated, of which three each can be swiveled out of the cabinet body at a fitting 22 on the left side and a fitting 22 on the right side (FIG. 15). The six shelves 21 are adjustable in height at the fittings 22, as FIG. 14 shows, and have approximately the same outline as a quarter circle. One corner 23 of the shelf 21 is flattened and adapted to the back wall 20. The fitting 22 is secured to one of the inner walls 3 of the cabinet body 1 in the vicinity of the front side of the cabinet body 1.

Four triangular shelves 24 are provided one above the other in the middle of the cabinet body. These shelves are secured, adjustably in height, on a fitting 25 secured to the back wall 20 of the cabinet body 1. Opposite these shelves, the triangular sides of these shelves are adapted to the circular shape of the shelves 21.

Figure 16:
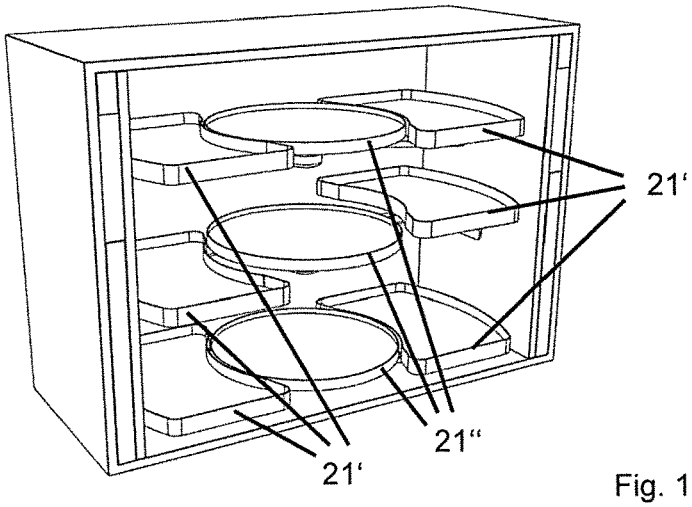
FIG. 16 is a perspective view of a cabinet body with six shelves that can be swiveled outward out of the cabinet body, and with three circular, rotatable shelves that cannot be swiveled outward from the cabinet body.
Figure 17:
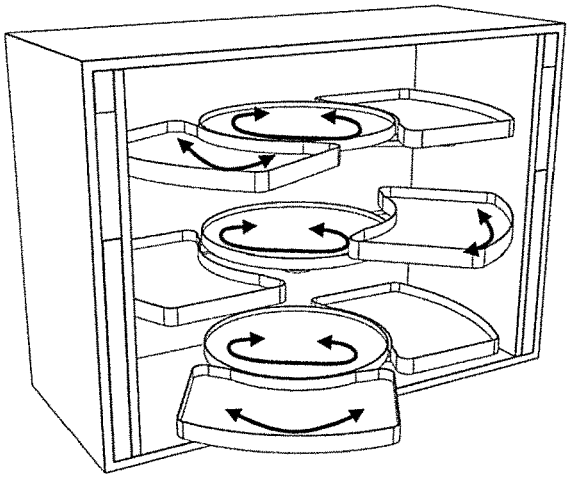
FIG. 17 is a perspective view as in FIG. 16.
Figure 18:
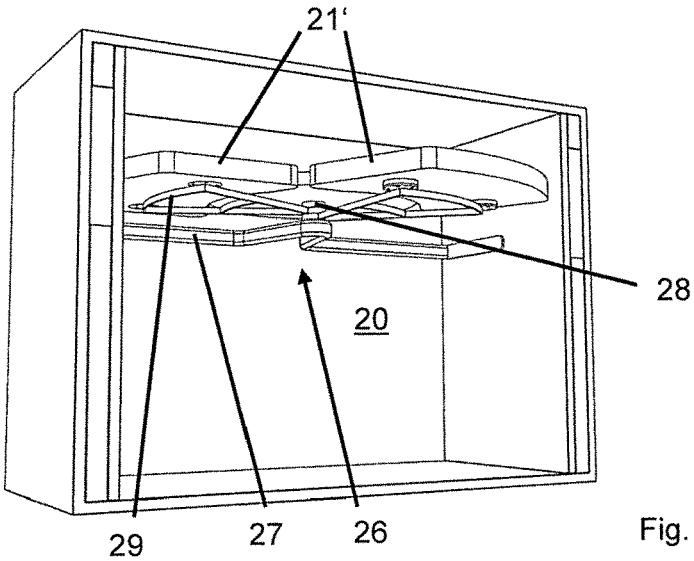
FIG. 18 is a perspective view of a cabinet body, in which a left shelf, a right shelf, and a circular shelf with an associated multi-way rotary fitting are shown from below.
Figure 19:
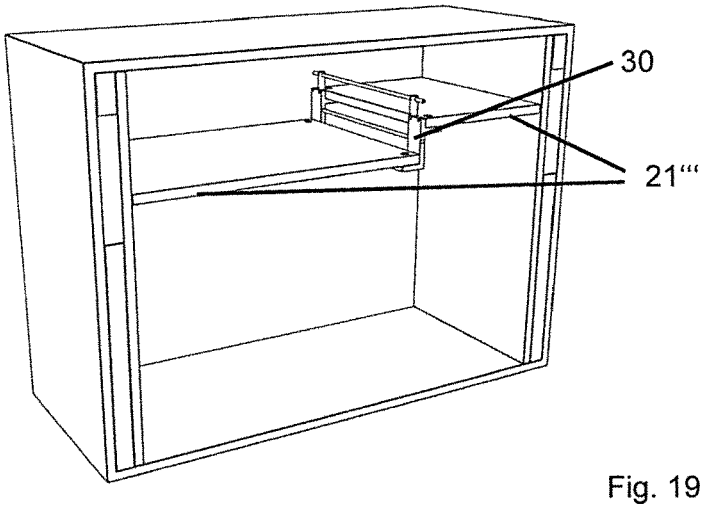
FIG. 19 is a perspective view of a cabinet body that has two shelves, connected via a fitting, which are connected to the inner walls via further fittings.
Figure 20:
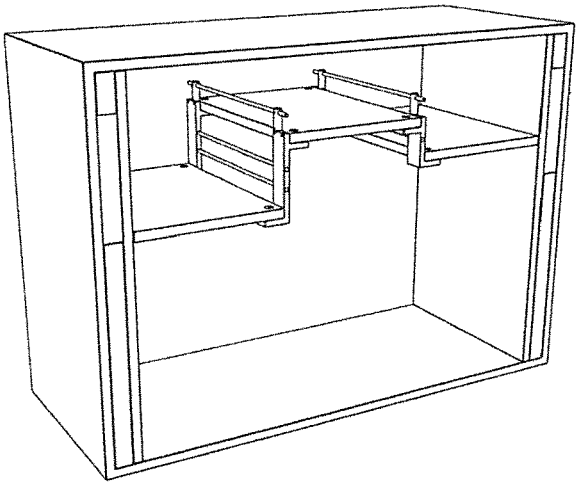
FIG. 20 is a further perspective view of a cabinet body that has three shelves connected to one another.
Figure 21:
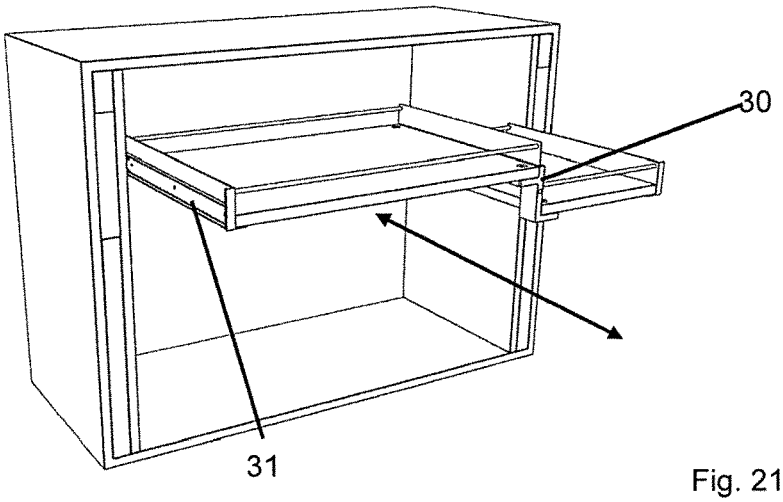
FIG. 21 is a perspective view of a cabinet body that has two shelves connected via a fitting and connected displaceably to the inner walls via further fittings.
Figure 22:
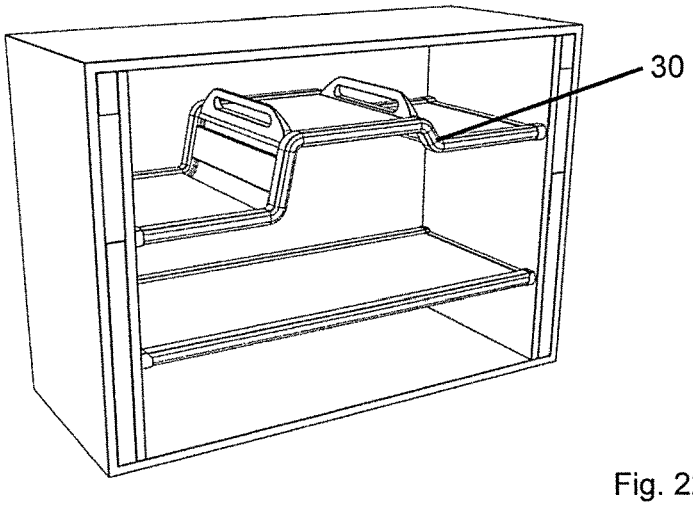
FIG. 22 is a further perspective view of a cabinet body that has three shelves connected to one another and one further shelf.
Figure 23:
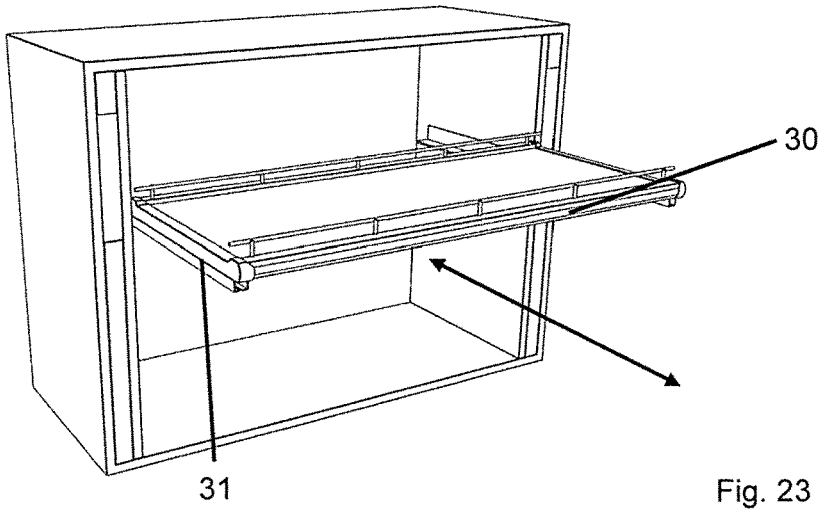
FIG. 23 is a perspective view of a cabinet body that has a shelf which is connected displaceably to the inner walls via fittings.
Figure 24:
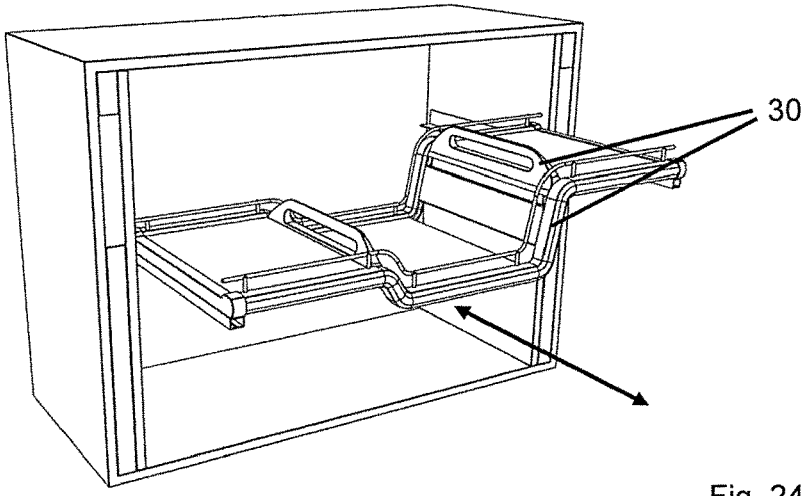
FIG. 24 is a further perspective view of a cabinet body that has three shelves connected to one another, which are connected displaceably to the inner walls via fittings.

In FIGS. 16-18, a further type of shelf swiveling is shown. In FIGS. 16 and 17, six shelves 21', specifically three left and three right shelves 21', are shown, of which two shelves 21' are each swivelable outward about a circular shelf 21" located in the middle of the cabinet body 1, while the circular shelf 21" can indeed be diverted, but not swiveled. The six shelves 21' are adapted on one side to the circular shape of the circular shelf 21". The swiveling actions are made possible by means of a multi-way rotary fitting 26, which is shown in FIG. 18. The multi-way rotary fitting 26 consists of a holder 27 which is secured essentially to the back wall 20 and which supports a swivel joint 28 both for the circular shelf 21" and for supports 29 of the shelves 21'. Thus all the shelves are rotatable or swivelable independently of one another.

FIGS. 19-24 show various embodiments of shelves 21''', which are connected to one another via fittings 30. The thus-connected shelves 21''' are connected to the inner walls 3 via further fittings 31 with corresponding guides at the fitting 31 and the inner wall 8; by way of these fittings 31, the shelves 21''' are both adjustable in height and can be shifted out of the cabinet body 1.

Figure 25:
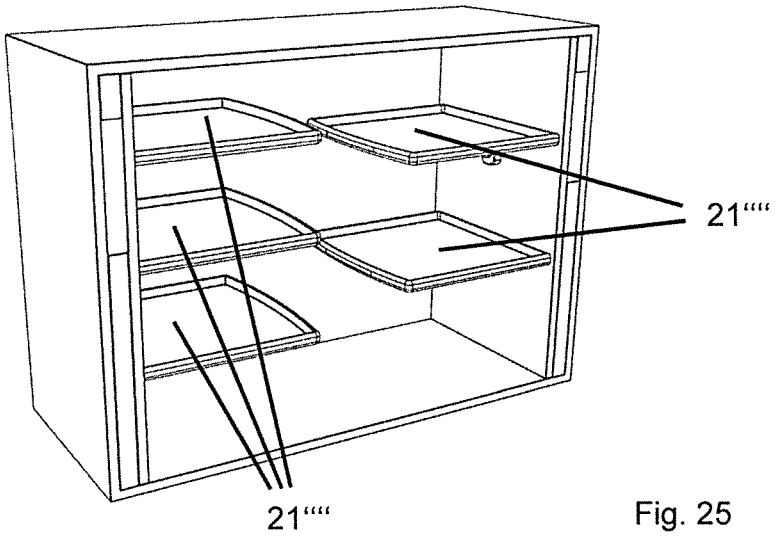
FIG. 25 is a perspective view of a cabinet body that has five shelves, which are located on the inner walls via fittings.
Figure 26:
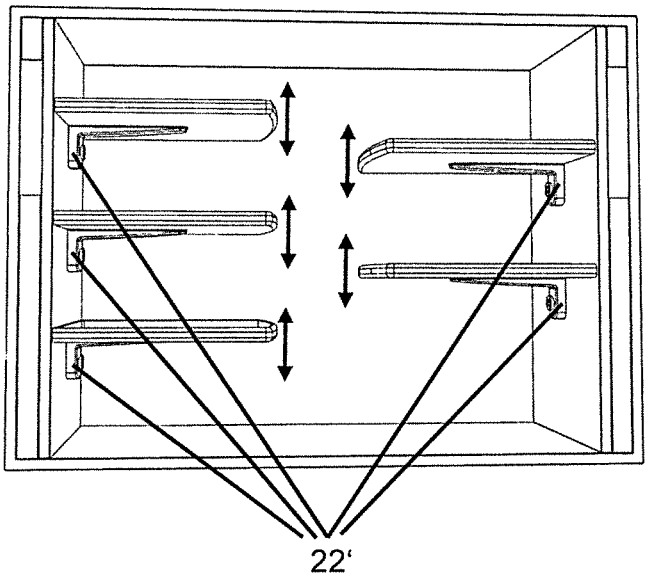
FIG. 26 is a perspective view of FIG. 25 that has shelves that are adjustable in height.

FIGS. 25 and 26 show a further embodiment with five shelves 21'''', which are connected, adjustably in height, to the inner walls 3 via fittings 22'.

The shelves 21, 21', 21", 21''', 21'''', 24 can consist of different materials, such as plastic, wood, metal, glass, etc., and they can have transparent or fluorescent properties.

LIST OF REFERENCE NUMERALS

1 Cabinet body
2 Side wall
3 Inner wall
4 Tilt fitting
5, 5', 5" Front facing
6, 21, 21'-21'''', 24 Shelf
7, 7', 7" Guide device
8, 12 U-shaped profile element
9 Hinge
10 Vertical panel
11 Guide panel
13 Strut
14 Helical spring
15, 16 Mounting holes
17 Stop collar
18 Tilt fitting arm
19 Covering holder
20 Back wall
22, 22', 30, 25 Fitting
23 Shelf corner
26 Multi-way rotary fitting
27 Holder
28 Swivel joint
29 Support
31 Guide
32 Opening

The invention claimed is:

1. A cabinet having a cabinet body (1) that has walls (2, 20) the open side of which cabinet can be covered with at least one covering hinged to the cabinet body (1), the cabinet body having inner walls (3), each of which, with associated side walls (2), forms one vertically extending gap (S) that receives a fitting (4) for the covering and that can be covered by a front facing (5, 5', 5"), wherein the front facing (5, 5', 5") covers the gap (S) in the open position of the at least one covering characterized in that a guide device (7, 7', 7") with a stop (17) is provided that can be guided movably along a housing that is located between the side wall (2) and the associated inner wall (3); said stop (17) limiting the movement horizontally of the guide device in order to prevent the front facing (5, 5', 5") from being moved too far outward past the face end of the cabinet body (1);

wherein the front facing (5, 5', 5") is connected to the guide device and cooperates with the guide device (7, 7', 7"), by which the positions of the front facing (5, 5', 5") are adjustable.

2. The cabinet of claim 1,
characterized in that the guide device (7, 7', 7") has a vertical panel (10) that is plane-parallel and connected to the front facing (5, 5', 5"), and a guide panel (11), located perpendicular to this vertical panel (10); the guide panel (11) having a strut (13) that is operatively connected to a helical spring (14).

3. Front facings (5, 5', 5") for a cabinet having at least one covering hinged to a cabinet body (1),
characterized in that the at least one covering is movable between a closed and an open position;

the front facing (5, 5', 5") is connected to and cooperates with a guide device (7, 7', 7"), by which the positions of the front facing (5, 5', 5") are adjustable;

the guide device (7, 7', 7") can be guided movably along a housing that is located between a side wall (2) and an associated inner wall (3); and wherein the guide device has a stop (17) limiting the movement horizontally of the guide device in order to prevent the front facing (5, 5', 5") from being moved too far outward past the face end of the cabinet body (1).

* * * * *